United States Patent [19]

Swafford

[11] 4,034,581

[45] July 12, 1977

[54] SOCK WITH PLATE AND FLOAT PATTERN AND METHOD

[75] Inventor: Homer L. Swafford, Statesville, N.C.

[73] Assignee: Thorneburg Hosiery Mill, Inc., Statesville, N.C.

[21] Appl. No.: 680,179

[22] Filed: Apr. 26, 1976

[51] Int. Cl.[2] ..... D04B 9/46

[52] U.S. Cl. ..... 66/180; 66/136

[58] Field of Search ..... 66/136, 137, 180

[56] References Cited

U.S. PATENT DOCUMENTS

| | | | |
|---|---|---|---|
| 1,605,895 | 11/1926 | Lawson | 66/137 |
| 1,619,788 | 3/1927 | Taubel | 66/180 |
| 1,716,450 | 6/1929 | Lawson | 66/137 |
| 2,160,373 | 5/1939 | Struve | 66/180 |
| 2,528,067 | 10/1950 | Marlette | 66/180 X |
| 2,627,736 | 2/1953 | Lawson | 66/180 X |

*Primary Examiner*—Ronald Feldbaum

*Attorney, Agent, or Firm*—Bell, Seltzer, Park & Gibson

[57] ABSTRACT

The major portion of the leg of the sock is knit with first and second yarns of different colors in plated relationship with the first yarn being positioned on the outside and the second yarn being positioned on the inside so that the color of the first yarn predominates in the major portion of the leg of the sock. Spaced apart pattern areas are formed in the leg and are knit of the second yarn only with the first yarn being floated inside so that the spaced apart pattern areas are of a different color than the major portion of the leg. Single wale areas are positioned between the spaced apart pattern areas and the first and second yarns are knit in plated relationship so that these areas are the same color as the major portion of the leg. The single wale areas permit at least portions of the spaced apart pattern areas to be positioned closely adjacent each other so that a wide variety of different types of patterns can be knit in closely spaced relationship.

2 Claims, 4 Drawing Figures

SOCK WITH PLATE AND FLOAT PATTERN AND METHOD

This invention relates generally to patterened hosiery articles, and more particularly to socks with patterns produced by plating and floating at least two yarns and with portions of adjacent pattern areas being spaced apart by a single wale.

It is known to knit socks with plate and float patterns, that is socks which are knit of both a backing or body yarn and a facing or plating yarn and to knit spaced apart pattern areas of the backing or body yarn only while the facing or plating yarn is floated inside of these pattern areas. However, these single yarn pattern areas have been relatively widely spaced apart because of the difficulty in properly plating the backing and facing yarns in the areas between the pattern areas. Under these conditions, the types of patterns which could be knit have been limited.

With the foregoing in mind, it is an object of the present invention to provide a sock with plate and float pattern areas which are spaced apart by a single wale knit of two plated yarns and to provide a method of knitting this type of sock on a circular hosiery knitting machine which requires only minor modification of the machine.

In accordance with the present invention, the major portion of the leg of the sock and selected areas in the foot, if desired, include plate and float patterns knit with at least first and second yarns of different colors. The yarns are knit in plated relationship with the first yarn being positioned on the outside and the second yarn being positioned on the inside so that the color of the first yarn predominates in the major portion of the leg. Spaced apart single yarn pattern areas are provided in the leg and are knit of the second yarn only with the first yarn being floated inside of the spaced apart areas so that the color of the second yarn is present in the spaced apart pattern areas. Single wale areas are provided between at least portions of adjacent spaced apart pattern areas and these single wale areas are knit of both yarns with the first yarn being positioned on the outside so that these single wale areas are the same color as the areas extending throughout at least the major portion of the leg. The pattern area adjacent one side of the single wale areas may extend above the single wale areas and the pattern area at the opposite side of the single wale areas may extend below the single wale areas.

The sock of the present invention is knit on a circular hosiery knitting machine with very minor modifications thereof. For example, the patterning mechanism of the knitting machine is modified to raise selected single needles to take and knit both yarns and the angle of inclination of the stitch cam is increased so that the needles are drawn down to stitch drawing level at a faster than normal rate. The increase in the angle of inclination of the needle drawing down surface of the stitch cam aids in the proper plating of the two yarns on the single needle forming the single wale areas.

Other objects and advantages will appear as the description proceeds when taken in connection with the accompanying drawings, in which.

Figure 1:
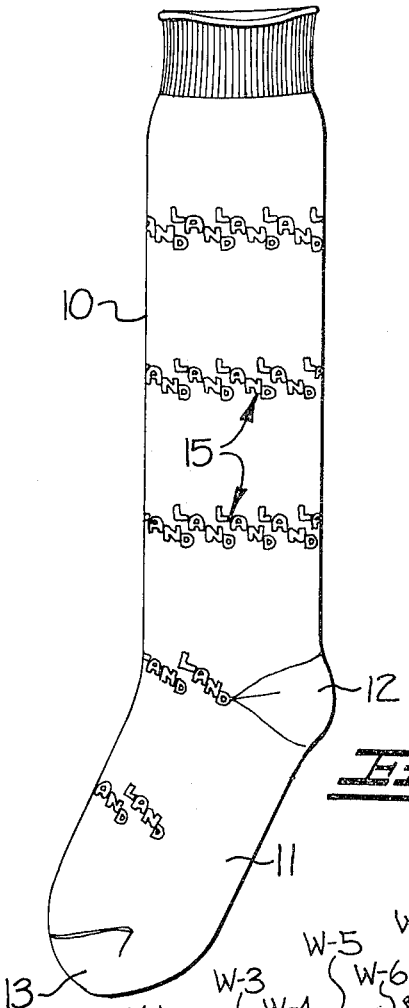
FIG. 1 is a side elevation of a sock illustrating one type of plate and float pattern which may be formed in accordance with the present invention.
Figure 2:
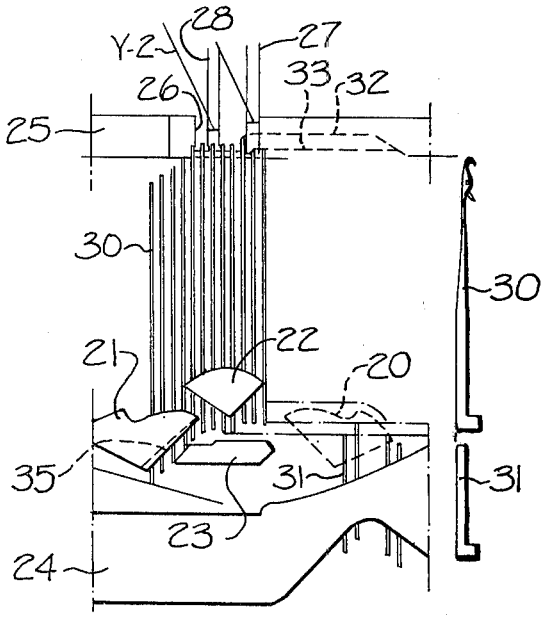
FIG. 2 is an enlarged fragmentary portion of an area of the plate and float pattern in the leg of the sock.

Although a particular plate and float pattern is illustrated in the drawings, it is to be understood that various other types of patterns may be knit in accordance with the present invention. The sock includes a leg portion 10 and a foot portion 11 with the usual heel and toe pockets 12, 13. The leg 10 and foot 11 are knit of at least first and second yarns of different colors to form successive courses providing adjacent wales in the leg portion.

Figure 3:
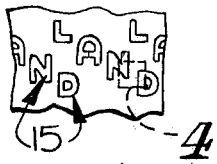
FIG. 3 is a greatly enlarged fragmentary view, taken within the dotted rectangle 3 in FIG. 2, and illustrating the manner in which the two yarns are knit and floated in this area of the pattern of the sock.

Plain or unpatterned areas extending throughout at least the major portion of the leg 10 are knit with both the first yarn Y-1 (FIG. 3) and a second yarn Y-2 in plated relationship. The first yarn Y-1 is positioned on the outside and the second yarn Y-2 is positioned on the inside so that the color of the first yarn predominates throughout the major portion of the leg 10 and foot 11 of the sock. In FIG. 3, the first yarn Y-1 is striped while the second yarn Y-2 is shown plain to illustrate that the two yarns are different colors. The first yarn Y-1 may also be referred to as a plating or facing yarn while the second yarn Y-2 may be referred to as a backing or body yarn.

Spaced apart pattern areas, broadly indicated at 15, are positioned in selected areas of the leg 10 and foot 11 and are illustrated as the letters L, A, N and D which are arranged in bands surrounding the sock. The letters forming the individual spaced apart pattern areas are stepped or offset vertically relative to adjacent pattern areas. As illustrated in FIG. 3, adjacent pattern areas 15 are each knit of the second yarn Y-2 only with the first yarn Y-1 being floated inside of the spaced apart pattern areas. It will be noted that a portion of one pattern area 15, knit only of the yarn Y-1 and forming the lower right-hand portion of the letter N, is illustrated in wales W-2 and W-3 of courses C-1 through C-7 and in wale W-1 of courses C-4 through C-6. The adjacent pattern area 15, knit only of the second yarn Y-2 and forming the upper left-hand portion of the letter D, is illustrated in wales W-5 through W-9 of courses C-4 and C-5 and wales W-5 and W-6 of courses C-6, C-7 and C-8.

Single wale areas are provided between at least portions of the spaced apart pattern areas 15. The single wale area between the pattern areas 15 is illustrated in FIG. 3 in wale W-4 of courses C-4 through C-7. The single wale area is knit with both the first and second yarns Y-1 and Y-2 in plated relationship with the first yarn Y-1 being positioned on the outside and the second yarn Y-2 being positioned on the inside so that the single wale area has the same color as the first yarn. It will also be noted that the first yarn Y-1 is floated inside of the fabric adjacent opposite sides of the single wale area and behind the spaced apart pattern areas 15.

Thus, portions of the adjacent pattern areas 15 are staggered vertically relative to each other and portions of the adjacent pattern areas are vertically aligned and spaced apart by the single wale area covering four successive courses. The single wale area between adjacent pattern areas is illustrated in courses C-4 through C-7 of wale W-4 in FIG. 3. It will be noted that the pattern area 15 on the right-hand side of FIG. 3 extends below the four successive courses of the single wale area while the pattern area 15 on the left-hand side of FIG. 3 extends above the four successive courses forming the single wale area.

METHOD OF KNITTING

Figure 4:
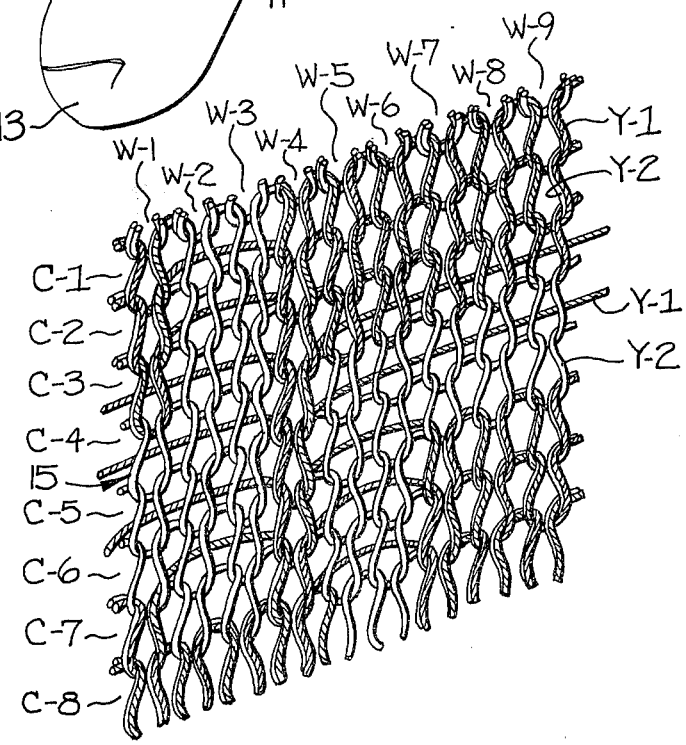
FIG. 4 is an internal development view of the knitting station of the machine, showing the relationship of the needles as they pass through the knitting station.

The method of knitting the sock of the present invention will be described as if it were knit on a conventional circular knitting machine which requires very little modification. As illustrated in FIG. 4, the machine includes a right-hand stitch cam 20, illustrated in an inactive or withdrawn dotted line position, a left-hand or main stitch cam 21, a top center cam 22 and a leveling cam 23. The usual fixed needle cams 24 are also provided to surround the needle cylinder, not shown. A latch ring 25 is provided with the usual yarn feeding throat 26. A conventional yarn feed finger 27 is provided for feeding the first yarn Y-1 at a relatively high elevation in throat 26 and a second yarn feed finger 28 is provided for feeding the second yarn Y-2 at a relatively low position in the yarn feeding throat 26.

The usual type of latch needles 30 and auxiliary jacks 31 are provided and selector jacks, not shown, extend below the auxiliary jacks 31 and are operated upon by the conventional selector levers and pattern drum, not shown, to selectively raise certain of the auxiliary jacks 31 and the needles 30 so that their hooks pass along an upper dotted line path 32. The hooks of the non-selected needles pass along a lower dotted line path 33. When the hooks of the needles are raised to the upper path 32, they pick up and knit both yarns Y-1 and Y-2 with the first yarn Y-1 being positioned on the outside of the fabric and the yarn Y-2 being positioned on the inside. When the hooks of the needles pass along the lower dotted line path 33, they pick up and knit only the second yarn Y-2 and the first yarn Y-1 is floated inside of these needles.

In knitting the leg 10 of the sock illustrated in FIG. 1 the needles are all raised so that their hooks pass along the upper dotted line path 32 and all of the needles pick up both yarns Y-1 and Y-2 and knit the same in plated relationship with the first yarn being positioned on the outside and the second yarn Y-2 being positioned on the inside throughout a plurality of courses until the first spaced apart pattern areas 15 are knit. During the knitting of the first few courses of the pattern areas 15, the needles between the pattern areas 15 pick up and knit both yarns while the hooks of the needles forming the pattern areas 15 move along the lower dotted line path 33 and pick up and knit only the second yarn Y-2. Thus, these portions of the pattern areas 15 of the single yarn Y-2 (FIG. 3) are adjacent to areas knit of both yarns. When the pattern areas 15 are separated by a single wale area, such as illustrated in wale W-4 of courses C-4 through C-7, only a single needle is raised to pass along the upper path 32 so that both yarns Y-1 and Y-2 are picked up and knit on this single needle while needles adjacent each side of this single needle pick up and knit only the yarn Y-2 and the yarn Y-1 is floated.

To aid in the proper plating of the two yarns on the single needle knitting the single wale area, the inclination of the left-hand stitch has been increased from the usual 45° angle, indicated by the dotted line 35 in FIG. 4, to an angle of approximately 50 degrees so that the needles are lowered at a faster rate. This faster draw down of the needles permits the needles on opposite sides of the single needle to float one of the yarns and permits the proper plating of the two yarns on the single needle forming the single wale area.

The sock and method of knitting of the present invention thus permits single yarn spaced apart pattern areas to be closely spaced together so that only a single wale is positioned between adjacent spaced apart pattern areas. The two yarns in the single wale areas are properly plated so that well-defined pattern areas are provided with a single wale distinctive line separating the adjacent pattern areas.

In the drawings and specification there has been set forth a preferred embodiment of the invention, and although specific terms are employed, they are used in a generic and descriptive sense only and not for purposes of limitation.

That which is claimed is:

1. In a sock including a leg consisting of successive courses knit of at least first and second yarns of different colors with the stitch loops forming adjacent wales, the combination therewith of a plate and float pattern comprising a. areas extending throughout at least a major portion of said leg and being knit with said first and second yarns in plated relationship and with said first yarn being positioned on the outside and said second yarn being positioned on the inside so that the color of said first yarn predominates in said areas, b. spaced apart pattern areas in said leg being knit of said second yarn only with said first yarn being floated inside of said spaced apart pattern areas, and c. single wale areas extending over at least three successive courses between said spaced apart pattern areas (b) in which said first and second yarns are knit in plated relationship with said first yarn being positioned on the outside and said second yarn being positioned on the inside so that said single wale areas are the same color as said first yarn and with said first yarn being floated inside of the wales adjacent opposite sides of said single wale areas and in said spaced apart pattern areas said spaced apart pattern areas (b) adjacent one side of said single wale areas (c) extend below said three successive courses and said spaced apart pattern areas (b) at the opposite side of said single wale areas (c) extend above said three successive courses .

2. A method of knitting a sock by including a leg having a plate and float pattern of successive courses knit of at least first and second yarns of different colors with the stitch loops forming adjacent wales in each of the successive courses, said method comprising the steps of a. knitting areas extending throughout at least a major portion of the leg with the first and second yarns in plated relationship and with the first yarn being positioned on the outside and the second yarn being positioned on the inside so that the color of the first yarn predominates in said areas, b. knitting spaced apart pattern areas in the leg with the second yarn only and with the first yarn being floated inside of said spaced apart pattern areas, and c. knitting single wale areas extending over at least three successive courses of the first and second yarns in plated relationship between said spaced apart pattern areas (b) with the first yarn being positioned on the outside and the second yarn being positioned on the inside so that said single wale areas are the same color as the first yarn and with the first yarn being floated inside of the wales adjacent opposite sides of said single wale areas and in said spaced apart pattern areas knitting said spaced apart pattern areas (b) at one side of said single wale areas (c) above said three successive courses, and opposite side of said single wale areas (c) below said three successive courses.

* * * * *

UNITED STATES PATENT AND TRADEMARK OFFICE

CERTIFICATE OF CORRECTION

PATENT NO. : 4,034,581

DATED : July 12, 1977

INVENTOR(S) : Homer L. Swafford

It is certified that error appears in the above-identified patent and that said Letters Patent are hereby corrected as shown below:

Column 3, line 65 following the word "stitch" insert -- cam--.

Column 6, line 4 following the word "and" insert --knitting said spaced apart pattern areas (b) at the --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*